US006694246B2

(12) United States Patent
Masuda et al.

(10) Patent No.: US 6,694,246 B2
(45) Date of Patent: Feb. 17, 2004

(54) CONTROLLER OF AN INTERNAL COMBUSTION ENGINE FOR DETERMINING A FAILURE OF A THERMOSTAT

(75) Inventors: Shun Masuda, Wako (JP); Hirohumi Muto, Wako (JP); Eisei Yamazaki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 103 days.

(21) Appl. No.: 10/128,612

(22) Filed: Apr. 22, 2002

(65) Prior Publication Data

US 2002/0156569 A1 Oct. 24, 2002

(30) Foreign Application Priority Data

Apr. 24, 2001 (JP) ..... 2001-125687

(51) Int. Cl.[7] ..... F01P 7/02; F01P 5/14

(52) U.S. Cl. ..... 701/114; 701/115; 123/41.1; 123/41.15

(58) Field of Search ..... 123/41.08, 41.09, 123/41.1, 41.14, 41.15, 198; 73/117.3, 118.1; 701/101, 102, 103, 112, 114, 115; 702/132, 183, 185; 374/1

(56) References Cited

U.S. PATENT DOCUMENTS 4,534,214 A * 8/1985 Takahashi ..... 73/118.1
4,546,646 A * 10/1985 Takahashi ..... 73/117.3
4,669,426 A * 6/1987 Hirano et al. ..... 123/41.15
5,153,835 A * 10/1992 Hashimoto et al. ..... 701/114
5,884,243 A * 3/1999 Taniguchi et al. ..... 702/183
6,128,948 A * 10/2000 Shi et al. ..... 73/118.1
6,321,695 B1 * 11/2001 Yoo et al. ..... 123/41.15
6,529,818 B2 * 3/2003 Kitajima et al. ..... 701/112
6,615,154 B2 * 9/2003 Fujimoto et al. ..... 702/132
2001/0050063 A1 * 12/2001 Niki ..... 123/41.15
2002/0111734 A1 * 8/2002 Wakahara et al. ..... 701/114

FOREIGN PATENT DOCUMENTS

JP 2000-008853 1/2000
JP 2001329840 A * 11/2001

* cited by examiner

*Primary Examiner*—Willis R. Wolfe
(74) *Attorney, Agent, or Firm*—Lahive & Cockfield, LLP

(57) ABSTRACT

A controller provided in accordance with the invention determines a failure of a thermostat that opens and closes a passage through which cooling water circulates between a radiator and an engine. The controller prohibits the failure determination if a water temperature of the engine decreases by more than a predetermined amount during a predetermined period from the time when a rotational speed of the engine exceeds a predetermined rotational speed. Thus, when the thermostat opens due to a high rotational speed of the engine, the failure determination is prohibited. Therefore, it is avoided that the thermostat operating normally is judged to be faulty.

20 Claims, 18 Drawing Sheets

CONTROLLER OF AN INTERNAL COMBUSTION ENGINE FOR DETERMINING A FAILURE OF A THERMOSTAT

BACKGROUND OF THE INVENTION

1. Technical Field

The present invention relates to a controller and a method for determining a failure of a thermostat provided in a cooling system of an internal-combustion engine.

2. Description of the Related Art

A vehicle comprises a radiator that supplies cooling water for cooling an internal combustion engine. The internal combustion engine and the radiator are connected via a passage, in which a thermostat is provided for opening and closing the passage. The thermostat includes a valve that is driven to open and close according to a temperature of cooling water. The thermostat closes when the temperature of cooling water is low, so that the cooling water circulates within the engine. The thermostat opens when a temperature of cooling water is high, so that the cooling water circulates between the radiator and the engine.

There are typically two types of thermostat failures. One is an opening failure where the thermostat is kept open and is unable to close. The other is a closing failure where the thermostat is kept closed and is unable to open. If the opening failure occurs when the engine in a cooled state is started, the cooling water from the radiator circulates through the engine, thus interfering with a rise in the water temperature of the engine. If the closing failure occurs, the water temperature of the engine continues to rise and may exceed a predetermined temperature because the cooling water does not circulate between the engine and the radiator. In the closing failure, the engine may overheat.

When a failure occurs in the thermostat, it is desirable to detect the failure quickly and give a driver a warning of the failure. In case of the closing failure, the driver can recognize its occurrence because a water temperature meter provided in a display panel of the vehicle indicates a rapid increase. On the other hand, in case of the opening failure, the driver cannot promptly recognize it.

A method for detecting the opening failure of a thermostat is disclosed in Japanese Patent Application Unexamined Publication (Kokai) No. 2000-8853, which is assigned to the same assignee of the present invention. According to the method, if a detected water temperature has not reached a predetermined normal determination value when an estimated water temperature, which is determined according to driving conditions of the engine, has reached a predetermined failure determination value, it is determined that the opening failure has occurred in the thermostat. In other words, if a rise in the detected water temperature is less than a rise in the estimated water temperature, it is determined that the opening failure has occurred in the thermostat.

An engine has a characteristic that a water pressure of the cooling water that circulates through the engine increases in proportion to a rotational speed of the engine. When the engine operates at a higher rotational speed, the water pressure may exceed a set pressure which is specific to the thermostat.

If the water pressure exceeds the set pressure, the thermostat opens irrespective of the water temperature of the engine. The opening of the thermostat may cause a situation in which the water temperature of the engine does not rise.

In this situation, the above conventional method may determine that a failure has occurred in the thermostat because the detected water temperature of the engine does not reach the normal determination value. This determination is wrong because the opening operation of the thermostat caused by a high rotational speed of the engine is normal.

Thus, there is a need for a controller and a method for prohibiting a determination of a failure of the thermostat when the thermostat is opened due to a high rotational speed of the engine.

SUMMARY OF THE INVENTION

According to one aspect of the invention, a controller determines a failure of a thermostat that opens and closes a passage through which cooling water circulates between a radiator and an engine. The controller prohibits the failure determination if a water temperature of the engine decreases by more than a predetermined amount during a predetermined period from the time when a rotational speed of the engine exceeds a predetermined rotational speed.

In accordance with the invention, when the thermostat opens due to a high rotational speed of the engine, the failure determination is prohibited. Therefore, it is avoided that the thermostat operating normally is judged to be faulty.

According to one embodiment of the invention, the controller further updates a maximum value of the water temperature of the engine during the predetermined period. The amount of the decrease in the water temperature is measured with respect to the maximum value. Thus, it can be easily determined whether the thermostat has opened due to a high rotational speed of the engine. The failure determination is prohibited at an appropriate timing.

According to another embodiment of the invention, the decrease of the water temperature of the engine is measured with respect to a water temperature detected in a previous cycle. Thus, the failure determination is prohibited when the thermostat is opened in the current cycle due to a high rotational speed of the engine.

According to another aspect of the invention, the controller carries out the thermostat failure determination process when all of the following conditions are met:

a) an outside air temperature at the time of starting the engine and the water temperature of the engine at the time of starting the engine are within predetermined ranges, respectively;

b) a difference between the outside air temperature at the time of starting the engine and the water temperature of the engine at the time of starting the engine is equal to or less than a predetermined value; and c) the outside air temperature does not decrease by more than a predetermined amount from the time of starting the engine. Thus, the thermostat failure determination is carried out under circumstances where the engine is sufficiently soaked and a variation in the outside air temperature is small.

According to another aspect of the invention, an estimated water temperature is determined. A rise in the water temperature of the engine detected by a sensor is compared with a rise in the estimated water temperature. The controller determines whether a failure has occurred in the thermostat based on the comparison result. By using the estimated water temperature, it can be determined whether a rise in the detected water temperature is appropriate.

According to one embodiment of the invention, the estimated water temperature is determined based on the water temperature of the engine that is detected at the time of starting the engine and a thermal load that contributes to an increase in the water temperature of the engine. Thus, the accuracy of the failure determination is improved.

DESCRIPTION OF THE PREFERRED EMBODIMENTS

Figure 1:
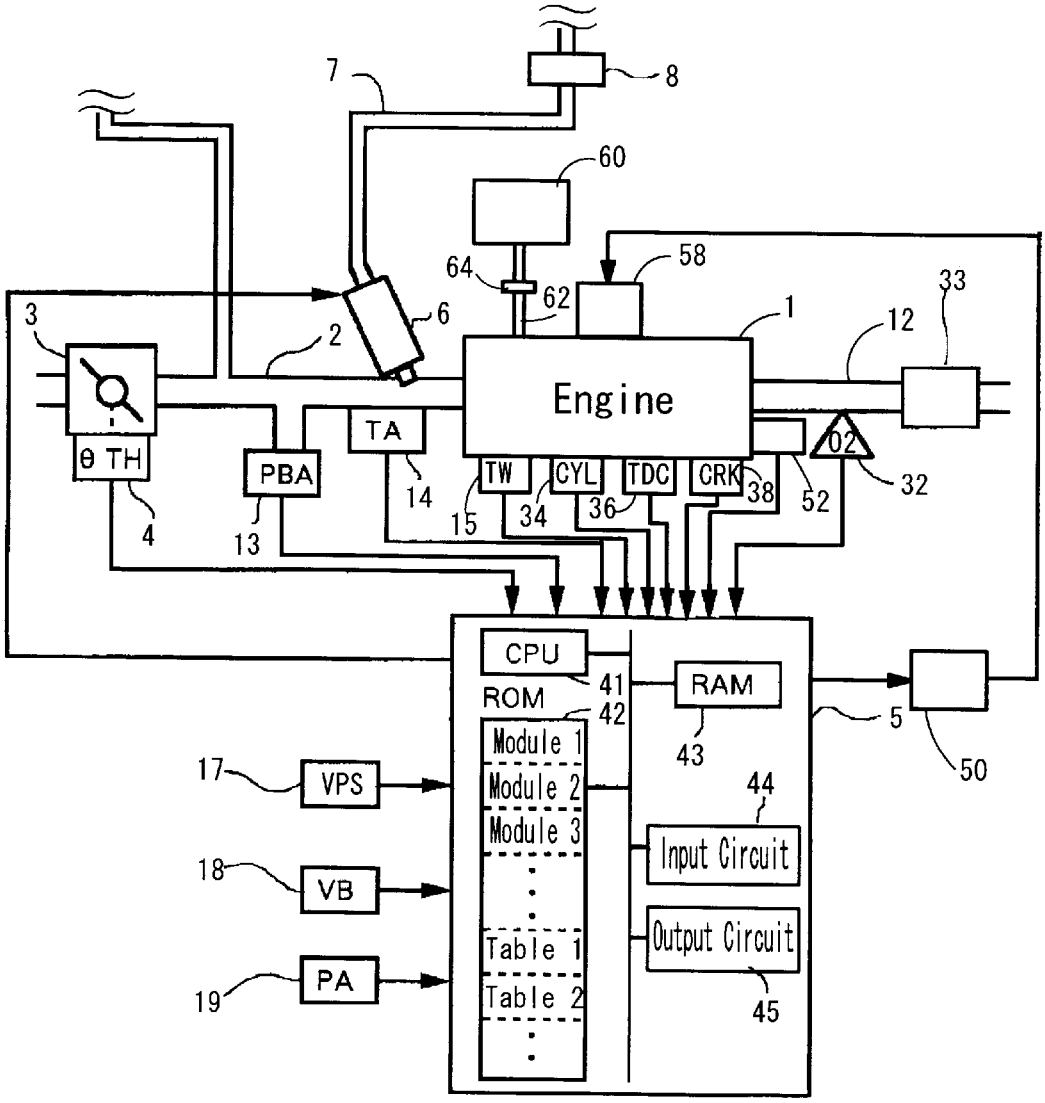
FIG. 1 is a block diagram showing a controller of internal combustion engine according to one embodiment of the invention.

Referring now to the drawings, specific embodiments of the invention will be described. FIG. 1 is a block diagram showing a controller of an internal-combustion engine in accordance with the embodiment of the invention.

An electronic control unit (hereinafter referred to as ECU) 5 comprises CPU 41 for carrying out operations for controlling each part of the engine 1, a read only memory (ROM) 42 for storing programs and various data to control each part of the engine 1, a random access memory (RAM) 43 for providing work areas for operations by the CPU 41 and storing temporarily data sent from each part of the engine 1 as well as control signals to be sent out to each part of the engine 1, an input circuit 44 for receiving data sent from each part of the engine 1, and an output circuit 45 for sending control signals to each part of the engine 1.

Programs are represented by Module 1, Module 2, Module 3 and so on in FIG. 1. A program which determines a failure of a thermostat according to the invention is contained in any one or more of these modules. Various data to be used for operations are stored in the form of Table 1, Table 2 and so on in ROM 42. ROM 42 may be a rewritable ROM such as EEPROM. ECU 5 can store the result of its operations in the rewritable ROM in a certain operating cycle to utilize them in the next operating cycle. Also, many flags set by various processes can be recorded in the ROM. These flags can be utilized for a failure diagnosis purpose.

The internal-combustion engine (hereinafter referred to as engine) is, for example, an engine equipped with four cylinders. An intake manifold 2 is connected to the engine 1. A throttle valve 3 is disposed upstream of the intake manifold 2. A throttle valve opening (θTH) sensor 4, which is connected to the throttle valve 3, outputs an electric signal corresponding to an opening angle of the throttle valve 3 and sends the electric signal to the ECU 5.

A fuel injection valve 6 is installed for each cylinder at an intermediate point in the intake manifold 2 between the engine 1 and the throttle valve 3. The opening time of each injection valve 6 is controlled by a control signal from the ECU 5. A fuel supply line 7 connects these fuel injection valves 6 and the fuel tank (not shown). A regulator (not shown) that is provided between the pump 8 and the respective fuel injection valves 6 acts to maintain the differential pressure between the pressure of the air taken in from the intake manifold 2 and the pressure of the fuel supplied via the fuel supply line 7 at a constant value. In cases where the pressure of the fuel is too high, the excess fuel is returned to the fuel tank 9 via a return line (not shown). Thus, the air taken in via the throttle valve 3 passes through the intake manifold 2. The air is mixed with the fuel injected from the fuel injection valves 6, and is then supplied to the cylinders of the engine 1.

An intake manifold pressure (PBA) sensor 13 and an outside air temperature (TA) sensor 14 are mounted in the intake manifold 2 downstream of the throttle valve 3. These sensors convert the intake manifold pressure and outside air temperature into electrical signals, and send these signals to the ECU 5.

An engine water temperature (TW) sensor 15 is attached to the cylinder peripheral wall, which is filled with cooling water, of the cylinder block of the engine 1. The sensor 15 detects the temperature of the engine cooling water. The detected engine water temperature is converted into an electrical signal, and the signal is sent to the ECU 5.

A cylinder discrimination sensor 34 is attached to the periphery of the camshaft or the periphery of the crankshaft of the engine 1, and outputs a cylinder discrimination signal CYL indicating which cylinder has reached a TDC position (top dead center). The output signal CYL is sent to the ECU 5.

Similarly, a TDC sensor 36 is attached to the periphery of the camshaft or the periphery of the crankshaft of the engine 1 and outputs a TDC signal pulse at a crank angle cycle (for example, for BTDC 10 degrees) associated with a TDC position of the piston. Furthermore, a crank angle sensor 38 is attached to output a CRK signal pulse at a predetermined crank angle cycle (for example, a cycle of 30 degrees) that is shorter than the TDC signal pulse cycle. These pulse signals are sent to the ECU 5.

The engine 1 has an exhaust manifold 12, and exhaust gases are discharged via a ternary catalyst 33 constituting an exhaust gas cleansing device, which is installed at an intermediate point in the exhaust manifold 12. An O2 sensor 32 mounted at an intermediate point in the exhaust manifold 12 is an exhaust density sensor for detecting an oxygen density in the exhaust gas. The detected signal is sent to the ECU 5.

An ignition plug 58 is provided in the combustion chamber (not shown) of the engine 1. The ignition plug 58 is electrically connected to the ECU 5 through an ignition coil and an igniter 50. Additionally, a knock sensor 52 is attached to a cylinder head (not shown) of the engine 1 to output a signal in accordance with vibrations of the engine 1. The output signal is sent to the ECU 5.

A wheel speed (VPS) sensor 17 is provided in the periphery of a drive shaft (not shown) of the vehicle on which the engine 1 is mounted. The wheel speed sensor 17 outputs a pulse at every wheel rotation. The output pulse signal is sent to the ECU 5.

A battery voltage (VB) sensor 18 and an atmospheric pressure (PA) sensor 19 are connected to the ECU 5. The VB sensor 18 and PA sensor 19 detect a battery voltage and the atmospheric pressure, respectively. The detected signals are sent to the ECU 5.

Input signals from the various sensors are provided to an input circuit 44. The input circuit 44 shapes the input signal waveforms, corrects the voltage levels to specified levels, and converts analog signal values into digital signal values. The CPU 41 processes the resulting digital signals, performs operations in accordance with the programs stored in the ROM 42, and creates control signals. These control signals are sent to the output circuit 45. The output circuit 45 sends the control signals to actuators such as the fuel injection valves 6, igniter 50 and other actuators.

A radiator 60 is connected to the engine 1. Cooling water from the radiator 60 is supplied to the engine 1.

Figure 2:
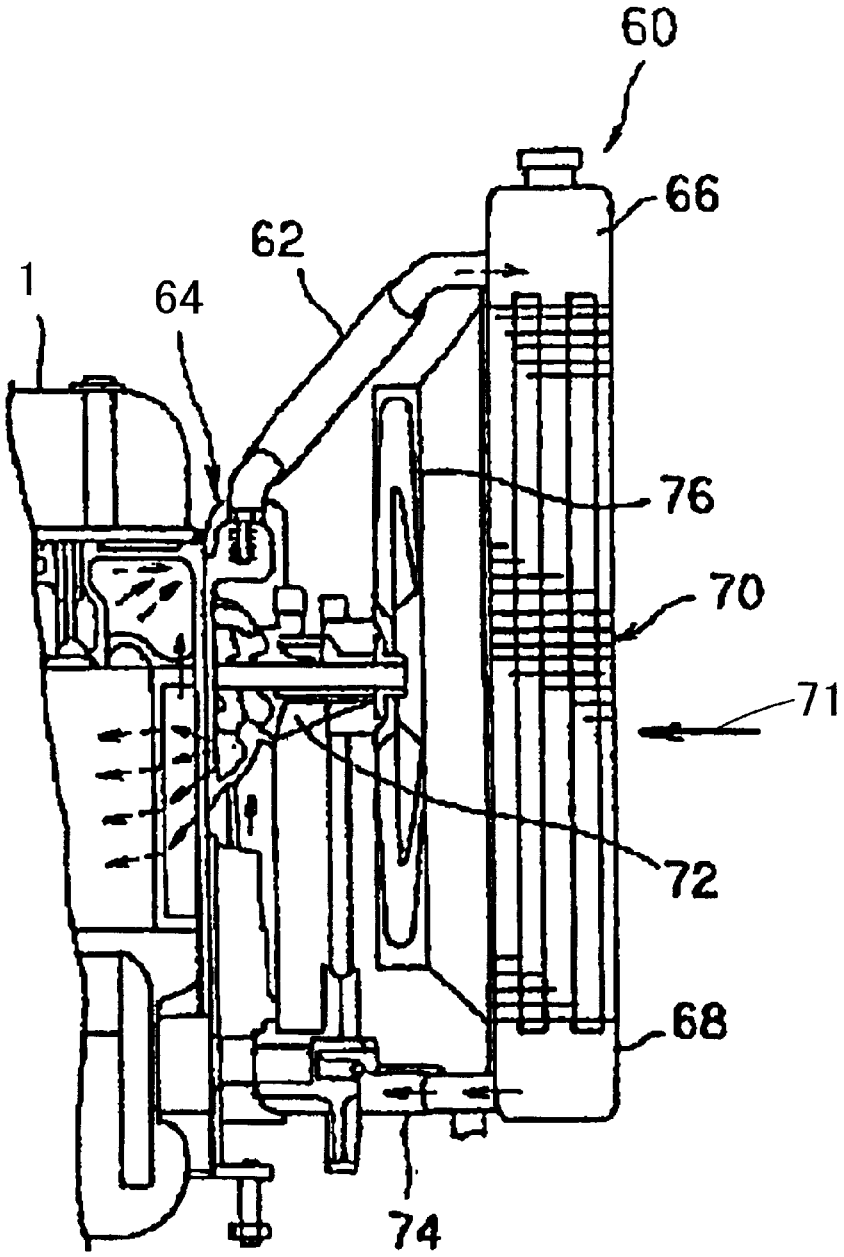
FIG. 2 is a cross-sectional view of a radiator according to one embodiment of the invention.

FIG. 2 is a cross-sectional view of the radiator 60. The engine 1 is connected to the radiator 60 via an inlet pipe (passage) 62. A thermostat 64 is provided in the inlet pipe 62.

The inlet pipe 62 is connected to an upper tank 66 of the radiator. A honeycomb-shaped core 70 is accommodated in a space extending from the upper tank 66 to a lower tank 68. Hot cooling water sent out from the engine 1 to the inlet pipe 62 is cooled while it flows through the cores 70. Then, the cooled cooling water is returned back to the engine 1 through the outlet pipe 74. Such circulation of the cooling water is forcibly carried out by means of a water pump 72 that is driven by the engine power.

The core 70 is not only cooled down by wind received from a direction in which the vehicle is headed as shown by an arrow 71 in FIG. 2, but also cooled down forcibly by a fan 76 which is provided at the back of the core and is driven by the engine power.

The thermostat 64 includes an opening/closing valve based on a bimetal. The thermostat 64 automatically opens or closes in accordance with the engine water temperature. When the engine water temperature is low, the thermostat 64 closes the inlet pipe 62 to prevent the cooling water from flowing into the core 70 from the engine 1. When the engine water temperature is high, the thermostat 64 opens the inlet pipe 62 to allow the hot cooling water to flow into the core 70 from the engine 1, thus cooling down the cooling water.

Figure 3:
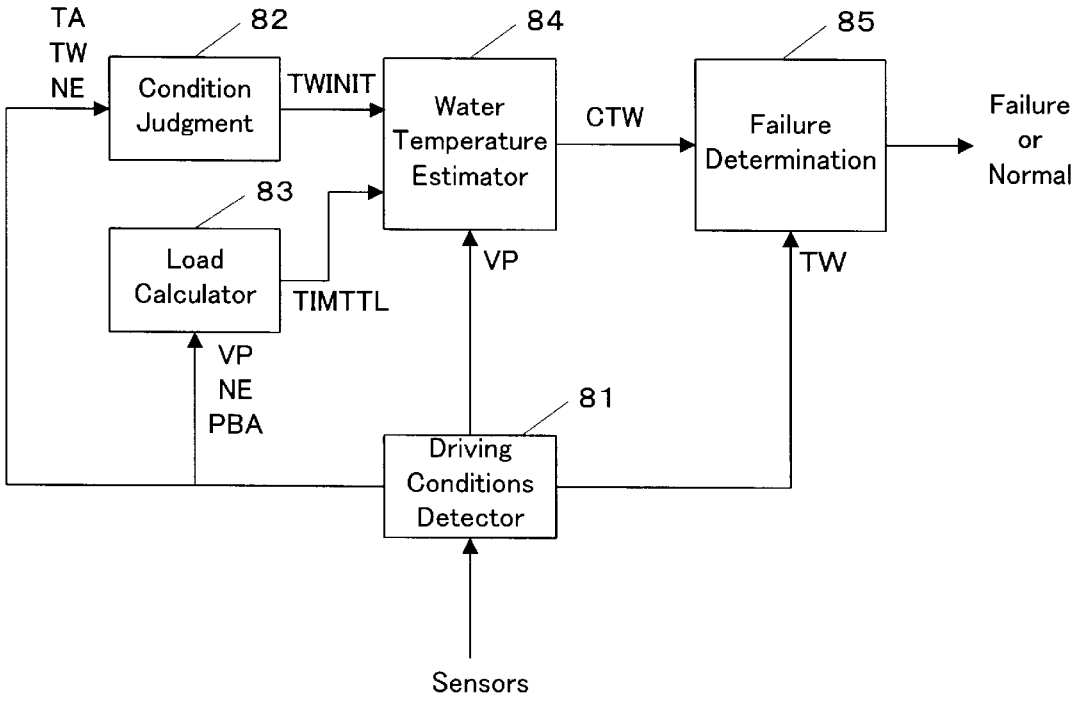
FIG. 3 is a functional block diagram of a controller for determining a failure of a thermostat according to one embodiment of the invention.

FIG. 3 is a functional block diagram showing a controller for determining a failure of the thermostat according to one embodiment of the present invention. A driving condition detector 81 detects driving conditions of the engine 1 based on signals from various sensors shown in FIG. 1. The driving conditions include such parameters as the vehicle speed VP, the engine rotational speed NE, the engine water temperature TW, and the outside air temperature TA. For example, the driving condition detector 81 determines the vehicle speed VP by counting pulses from the wheel speed sensor 17. The driving condition detector 81 also determines the engine rotational speed NE by counting pulses of the CRK signals from the CRK sensor 38.

A condition judgment part 82 judges whether predetermined conditions are met based on the driving conditions detected by the driving condition detector 81. If the predetermined conditions are met, the condition judgment part 82 permits the execution of the thermostat failure determination.

If the execution of the thermostat failure determination is permitted by the condition judgment part 82, a water temperature estimator 84 estimates an engine water temperature based on the driving conditions detected by the driving condition detector 81 and an engine load calculated by a load calculator 83. More specifically, the estimated water temperature CTW is determined based on an engine water temperature TWINIT that is detected at the time of starting engine and a thermal load parameter TITTL that contributes to an increase in the engine water temperature. The thermal load parameter TITTL is calculated based on an accumulated engine load value TIMTTL and an accumulated cooling loss value CLTTL. The thermal load parameter TITTL is calculated by the load calculator 83.

A failure determination part 85 compares a rise in the estimated water temperature CTW determined by the water temperature estimator 84, with a rise in the engine water temperature TW detected by the driving condition detector 81. The failure determination part 85 determines whether a failure has occurred in the thermostat based on the comparison results.

According to one embodiment of the invention, the condition judgment part 82 permits the execution of the thermostat failure determination when all of the following conditions are met:

1) the outside air temperature at the time of starting the engine and the engine water temperature at the time of starting the engine are within predetermined ranges, respectively;
2) a difference between the outside air temperature at the time of starting the engine and the engine water temperature at the time of starting the engine is equal to or less than a predetermined value;
3) the outside air temperature does not decrease by more than a predetermined value from the time of starting the engine; and
4) the engine water temperature does not decrease by more than a predetermined amount during a predetermined period from the time when the engine rotational speed exceeds a predetermined rotational speed.

The failure determination process is permitted if the engine is sufficiently soaked and a variation in the outside air temperature is small. The term "soaked" used herein means that the engine has been left so long that the engine water temperature has lowered to about the same level as the outside air temperature. If the above-mentioned conditions 1) and 2) are met, it indicates that the engine is sufficiently soaked. If the above-mentioned condition 3) is met, it indicates that a variation in the outside air temperature is small. For the above-condition 4), it will be described below with reference to FIG. 4.

When all the above conditions are not met, the condition judgment part 82 prohibits the execution of the failure determination in the current driving cycle. Here, one driving cycle indicates one cycle of the engine from start to stop.

Figure 4:
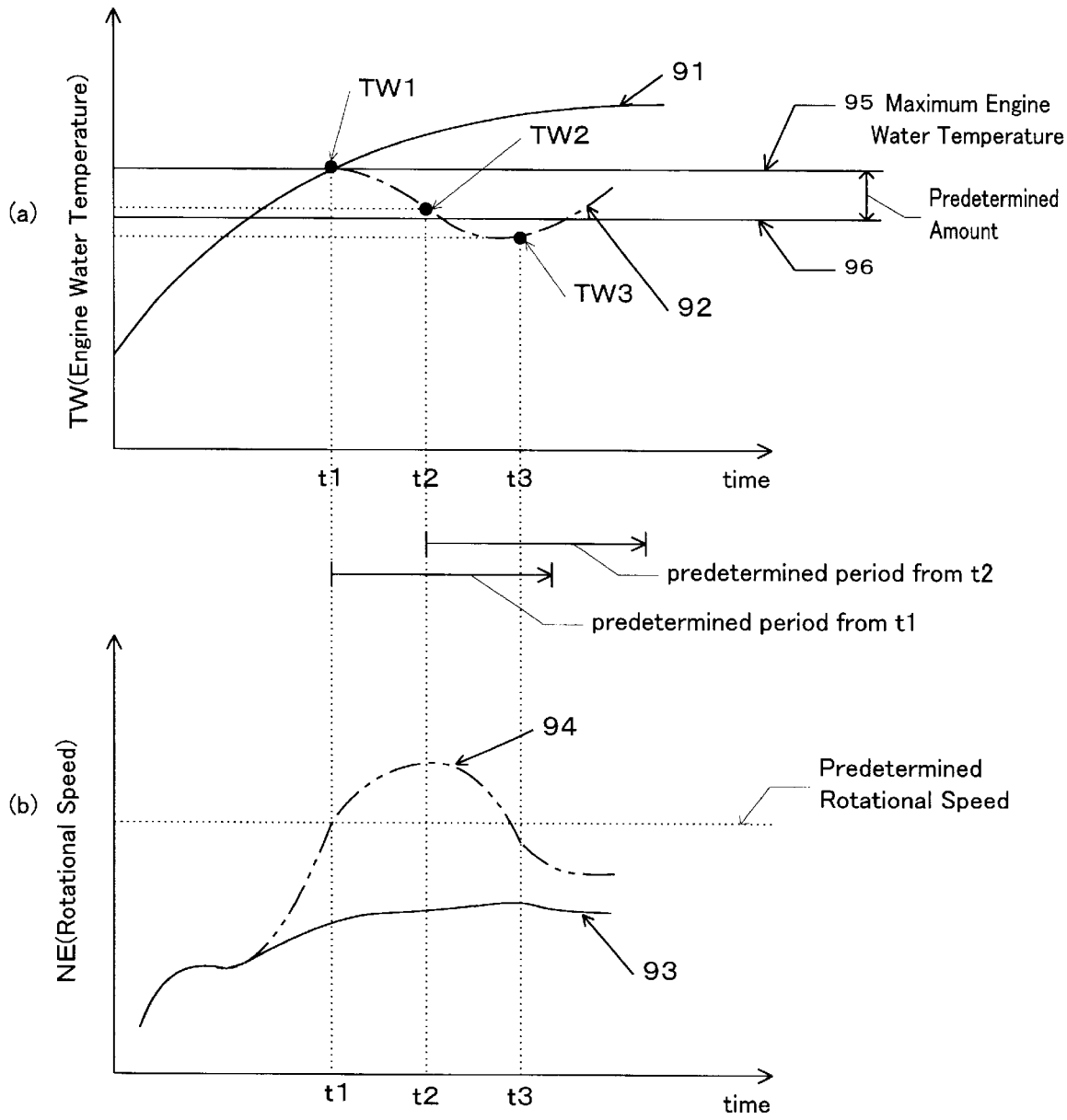
FIG. 4 is a schematic chart showing a method for determining whether the execution of the failure determination is permitted when an engine operates at a high rotational speed, according to one embodiment of the invention.

FIG. 4 is a schematic chart showing a method for determining whether the execution of the failure determination is permitted when a high engine rotational speed is detected, in accordance with one embodiment of the invention. FIG. 4(*a*) shows a transition of the engine water temperature TW after the engine is started. FIG. 4(*b*) shows a transition of the engine rotational speed NE after the engine is started. The failure determination according to one embodiment of the invention is performed at a predetermined cycle. In the example shown in FIG. 4, the failure determination process is performed at each time point of t1, t2 and t3.

A curve 91 shows an example of a change in the engine water temperature TW when the engine rotational speed NE has changed as shown by a curve 93. A curve 92 shows an example of a change in the engine water temperature TW when the engine rotational speed NE has changed as shown by a curve 94.

As shown in the curves 91 and 93, the engine water temperature TW gradually increases in accordance with the increase of the engine rotational speed NE. Because the engine rotational speed NE does not become so high, the thermostat is not opened by the water pressure of cooling water of the engine.

In contrast, as shown in the curves 92 and 94, the engine water temperature TW begins to decrease when the engine rotational speed NE exceeds a predetermined rotational speed (time t1). This is because the thermostat is opened by the water pressure of cooling water of the engine when the water pressure has exceeded a set pressure inherent in the thermostat due to a high rotational speed NE. This decrease in the water temperature is not caused by a thermostat opening failure (or other thermostat failures).

In a conventional manner, this decrease in the water temperature may lead to an erroneous determination that the thermostat has failed. According to the present invention, it is possible to avoid such an erroneous determination.

According to one embodiment of the invention, a maximum value of the engine water temperature is determined during a predetermined period from the time when the engine rotational speed NE exceeds the predetermined rotational speed. If the engine water temperature TW decreases by more than a predetermined amount with respect to the maximum value during the predetermined period, the execution of the failure determination process is prohibited.

More specifically with reference to FIG. 4, TW1 indicates an engine water temperature at time t1 when the engine rotational speed exceeds a predetermined engine rotational speed (5500 rpm for example). When the engine rotational speed exceeds the predetermined rotational speed at time t1, a measurement of the aforementioned predetermined period is started. The engine water temperature TW1 is set to the maximum engine water temperature as an initial value. In this example, the level of the maximum engine water temperature is indicated by a line 95. A level of the engine water temperature that is less than the maximum engine water temperature by a predetermined amount (for example, 2 degrees) is shown by a line 96.

At time t1 when the engine rotational speed NE exceeds the predetermined rotational speed, it is not determined that the decrease in the engine water temperature from the maximum engine water temperature is greater than the predetermined amount. Accordingly, at time t1, the thermostat failure determination process is performed.

At time t2 where the next cycle is carried out, the engine rotational speed NE still exceeds the predetermined rotational speed. The engine water temperature at this time is shown by TW2. At time t2, because the engine rotational speed exceeds the predetermined rotational speed, the above-mentioned predetermined period is newly measured from time t2. Because TW1 is greater than TW2 (TW1>TW2), the maximum engine water temperature is still TW1. A decrease amount of the engine water temperature at time t2 is "TW1−TW2". The decrease amount is less than the above-mentioned predetermined amount. Accordingly, the thermostat failure determination process is performed.

At time t3 where the further next cycle is carried out, the engine rotational speed NE is less than the predetermined rotational speed. The engine water temperature at this time is shown by TW3. The period which has been measured from the time t2 has not reached the length of the above-mentioned predetermined period. A decrease amount of the engine water temperature is examined. Because TW1 is greater than TW3 (TW1>TW3), the maximum engine water temperature is still TW1. The decrease amount of the engine water temperature at time t3 is "TW1−TW3". Since this decrease amount is more than the above-mentioned predetermined amount, the execution of the thermostat failure determination process is prohibited at time t3. Thereafter, the thermostat failure determination process will not be carried out in this driving cycle. Thus, a wrong failure determination which may be caused by a high rotation speed of the engine is avoided.

Alternatively, the execution of the failure determination process may be prohibited when the engine water temperature in the current driving cycle is lower by more than a predetermined amount than an engine water temperature that is determined in any cycle that are previously carried out.

Figure 5:
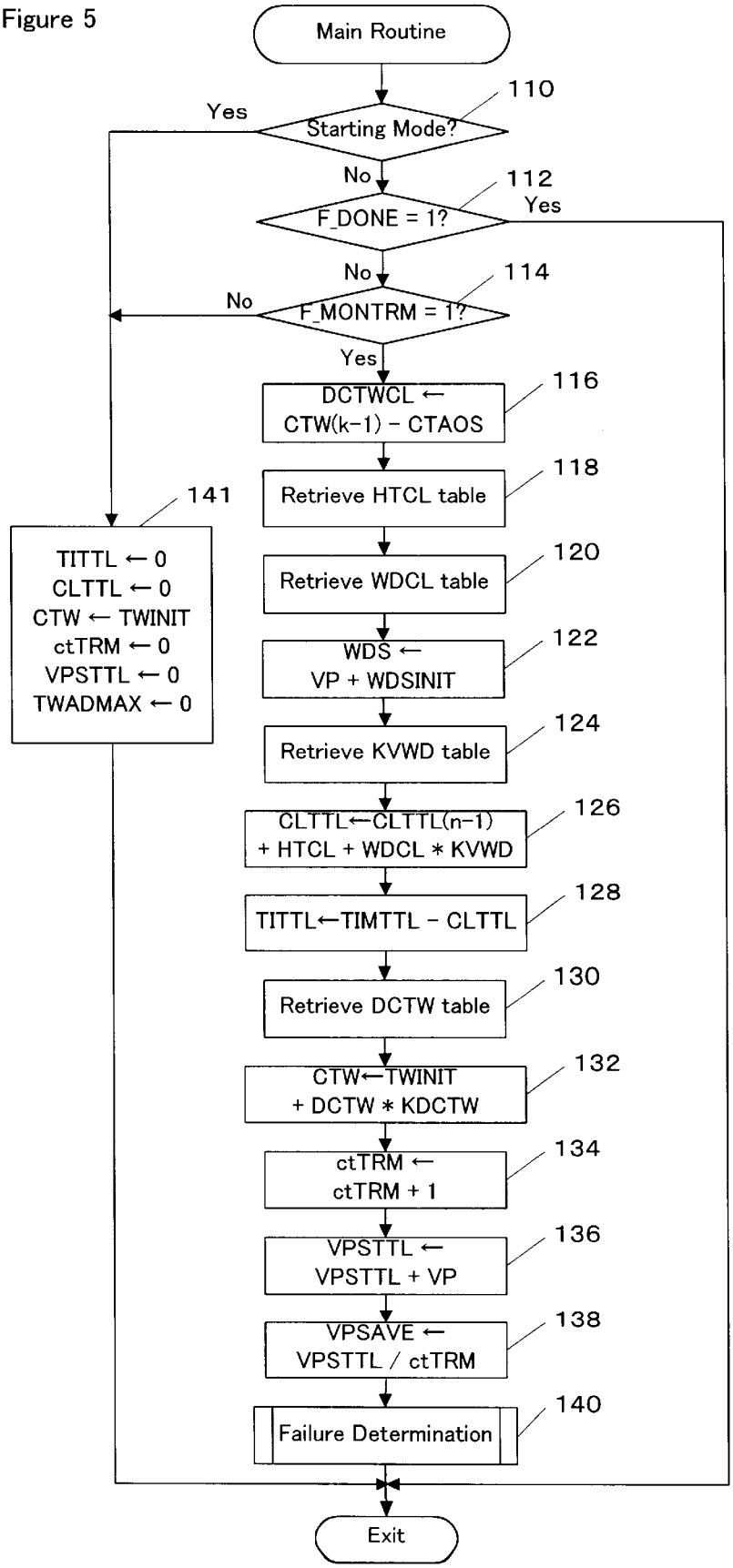
FIG. 5 is a flowchart showing a main routine for determining a failure of a thermostat according to one embodiment of the invention.

FIG. 5 is a flowchart showing a main routine for determining a failure of the thermostat according to one embodiment of the invention. The main routine is repeatedly performed at a predetermined interval (for example, every two seconds). In step 110, it is determined whether the engine 1 is in a starting mode. For example, if a starter motor (not shown) is being activated, it is determined that the engine 1 is in the starting mode. Alternatively, it may be determined that the engine 1 is in the starting mode if the engine rotational speed NE has reached a crank rotational speed.

If the starting mode is determined, the process proceeds to step 141, in which parameters are initialized. More specifically, the accumulated engine load value or thermal load parameter TITTL, the accumulated cooling loss value CLTTL, an post-start counter ctTRM for measuring an elapsed time from the start of the engine, and an accumulated vehicle speed value VPSTTL are initialized to zero. The estimated water temperature CTW is initially set to an engine water temperature TWINIT that is detected when the engine is started, and the maximum engine water temperature TWADMAX is initially set to zero.

When it is determined in step 110 that the engine 1 is not in the starting mode, the process proceeds to step 112, in which a value of a completion flag F_DONE is examined. The completion flag F_DONE is a flag that is to be set to 1 when the failure determination for the current driving cycle is completed. After the completion flag F_DONE is set to 1, any further failure determination process will not be carried out in the current driving cycle. Therefore, when the completion flag F_DONE is 1, this routine terminates in step 112.

The process proceeds to step 114, in which a value of a permission flag F_MONTRM is examined. The permission flag F_MONTRM is a flag that is to be set to 1 when the thermostat failure determination is permitted. When the permission flag F_MONTRM is zero, the process proceeds to step 141, in which the parameters are initialized as described above. When the permission flag F_MONTRM is 1, the process proceeds to step 116.

Steps 116 through 132 indicate a process for determining the estimated water temperature CTW. The estimated water temperature CTW is determined based on the engine water temperature TWINIT that is detected at the time of starting the engine and the thermal load parameter TITTL that contributes to an increase of the engine water temperature. The thermal load parameter TITTL is calculated based on the accumulated engine load value TIMTTL and the accumulated cooling loss CLTTL. Furthermore, the accumulated engine load value TIMTTL is calculated based on the fuel injection amount supplied to the engine, the engine rotational speed, and the engine load. The accumulated cooling loss value CLTTL is calculated based on a loss that is caused by wind, a heater of the vehicle, and so on.

In step 116, a difference DCTWCL between the estimated water temperature CTW(k−1) determined in the previous cycle and the estimated outside air temperature CTAOS determined at the start of the engine is determined. The estimated outside air temperature CTAOS is determined in step 205 or step 206 of FIG. 6, as described later. Here, "k" is a subscript for identifying a cycle. (k−1) indicates the previous cycle. (k), which indicates the current cycle, is omitted for the purpose of simplicity.

Figure 9:
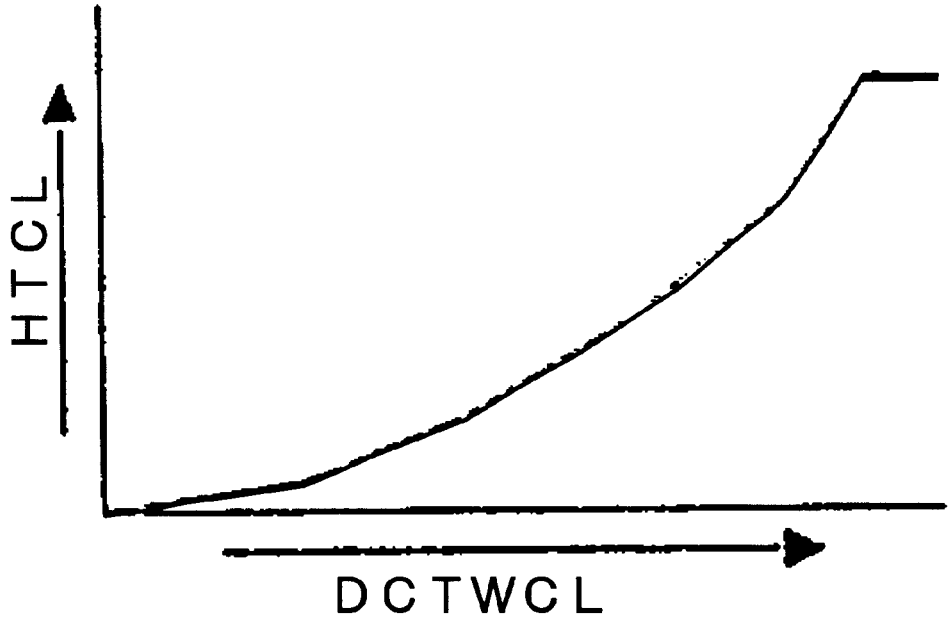
FIG. 9 shows an example of a heater loss (HTCL) table according to one embodiment of the invention.

The process proceeds to step 118. A HTCL table is retrieved based on the difference DCTWCL determined in step 116 to determine a heater cooling loss HTCL. The heater cooling loss HTCL indicates a loss when heat generated by a rise in the temperature of cooling water is used to heat the room of the vehicle. FIG. 9 shows an example of the HTCL table. As seen from FIG. 9, the heater cooling loss HTCL increases in accordance with the increase of the difference DCTWCL. The heater cooling loss HTCL is represented in the form of a corresponding fuel injection amount per unit time.

Figure 10:
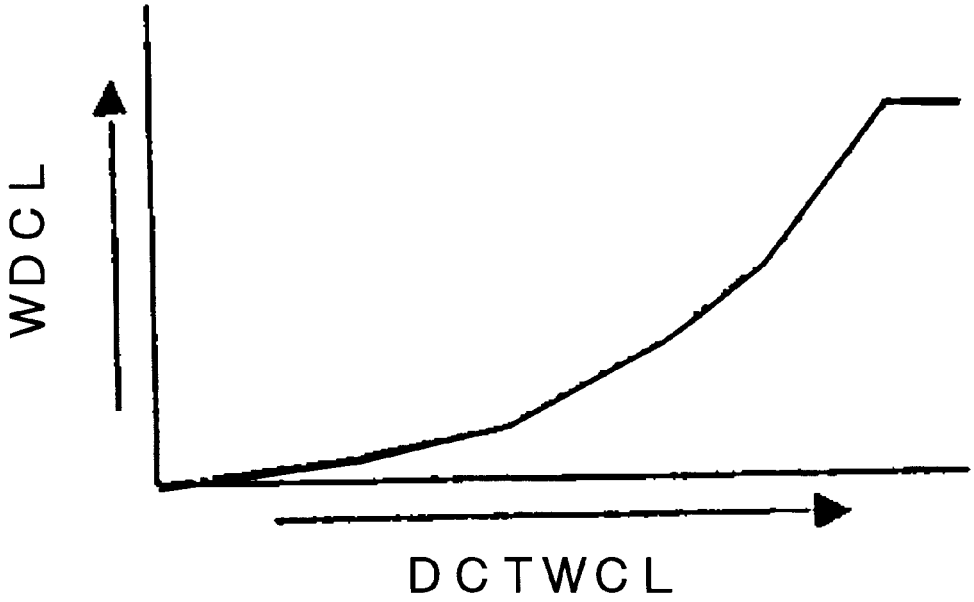
FIG. 10 shows an example of a wind cooling loss (WDCL) table according to one embodiment of the invention.

The process proceeds to step 120. A WDCL table is retrieved based on the difference DCTWCL determined in step 116 to determine a wind cooling loss WDCL. The wind cooling loss WDCL indicates a loss that is caused by the wind that the radiator receives. FIG. 10 shows an example of the WDCL table. As seen from FIG. 10, if the wind speed is constant, the wind cooling loss WDCL increases in accordance with the increase of the differences DCTWCL. The wind cooling loss WDCL is represented in the form of a corresponding fuel injection amount per unit time.

The process proceeds to step 122. A predetermined wind velocity WDSINIT in a state where high wind (for example, 50 km/h) blows is added to the vehicle speed VP (which is detected by the driving conditions detector 81 shown in FIG. 3) to determine an estimated relative wind velocity WDS.

Figure 11:
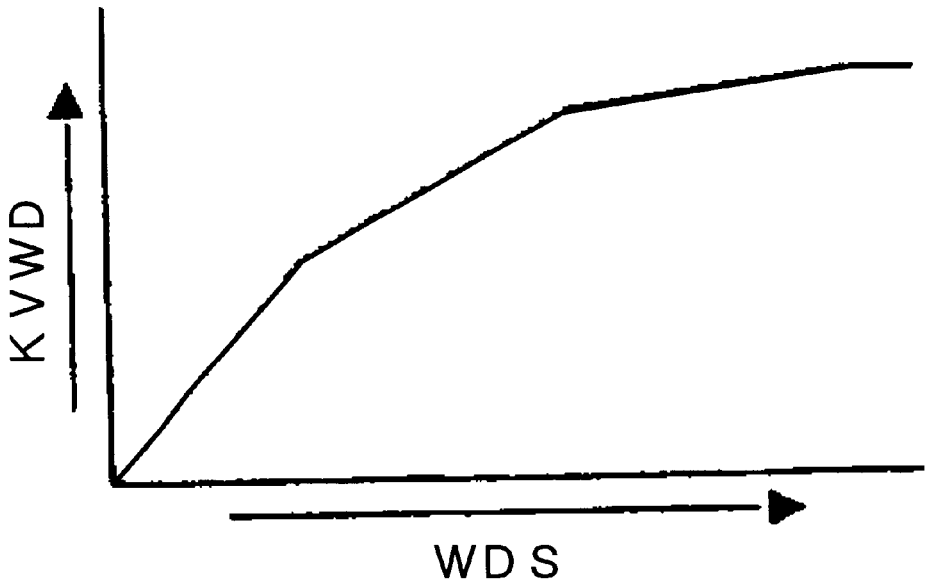
FIG. 11 shows an example of a wind velocity correction value (KVWD) table according to one embodiment of the invention.

In step 124, a KVWD table is retrieved based on the estimated relative wind velocity WDS determined in step 122 to determine a wind velocity correction value KVWD. An example of the KVWD table is shown in FIG. 11. As seen from FIG. 11, the wind velocity correction value KVWD increases in accordance with the increase of the estimated relative wind velocity WDS.

The process proceeds to step 126. The accumulated cooling loss value CLTTL is determined. More specifically, the heater cooling loss HTCL is added to a product of the wind cooling loss WDCL and the wind velocity correction value KVWD. Then, the added value is added to the accumulated cooling loss value CLTTL(k−1) determined in the previous cycle to determine the accumulated cooling loss value CLTTL for the current cycle. Thus, the accumulated cooling loss value CLTTL indicating a loss caused by the heater and wind is determined.

In step 1128, the thermal load parameter TITTL is calculated. More specifically, the accumulated cooling loss value CLTTL determined in step 126 is subtracted from the accumulated engine load value TIMTTL to determine the thermal load parameter TITTL. The accumulated engine load value TIMTTL is determined in step 410 of FIG. 8, as described later.

Figure 12:
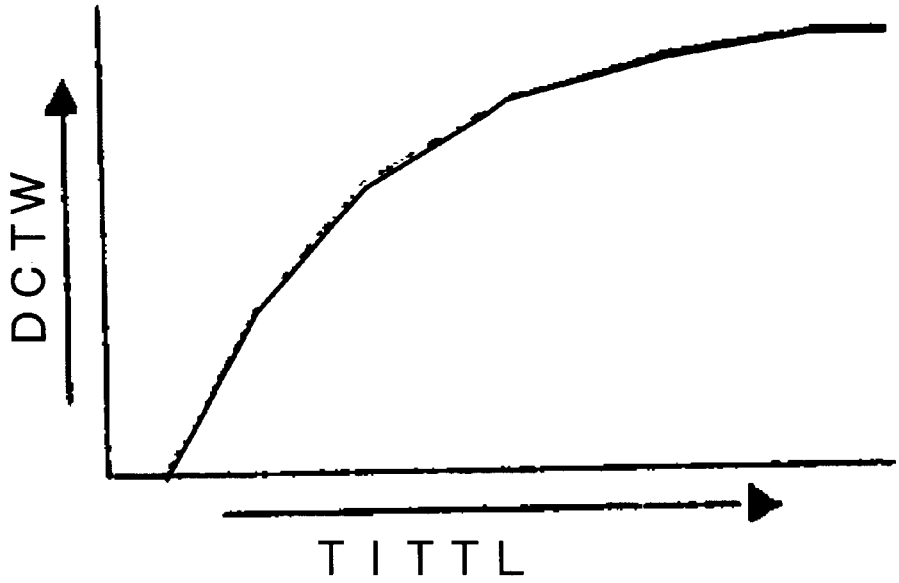
FIG. 12 shows an example of a water temperature estimation basic value (DCTW) table according to one embodiment of the invention.

In step 1130, a DCTW table is retrieved based on the thermal load parameter TITTL determined in step 128 to determine a water temperature estimation basic value DCTW. An example of the DCTW table is shown in FIG. 12. As seen in FIG. 12, the base value DCTW increases in accordance with the increase of the thermal load parameter TITTL.

The process proceeds to step 132. The base value DCTW determined in step 130 is multiplied by a water temperature correction value KDCTW determined at the start of the engine. The correction value KDCTW is determined in step 202 of FIG. 6, as described later. The multiplied value is added to the initial engine water temperature TWINIT. Thus, the estimated water temperature value CTW is determined based on the initial engine water temperature TWINIT and the thermal load parameter TITTL.

Steps 134 through 138 indicate a process for determining an average vehicle speed VPSAVE. In step 134, the value of the post-start counter ctTRM is incremented. In step 136, the vehicle speed VP detected in the current cycle is added to an accumulated vehicle speed value VPSTTL to update the accumulated vehicle speed value VPSTTL. In step 138, the updated accumulated vehicle speed value VPSTTL is divided by the value of the post-start counter ctTRM to determine the average vehicle speed VPSAVE after the start of the engine. The process proceeds to step 140, in which a thermostat failure determination routine (FIG. 7) is executed.

Figure 6:
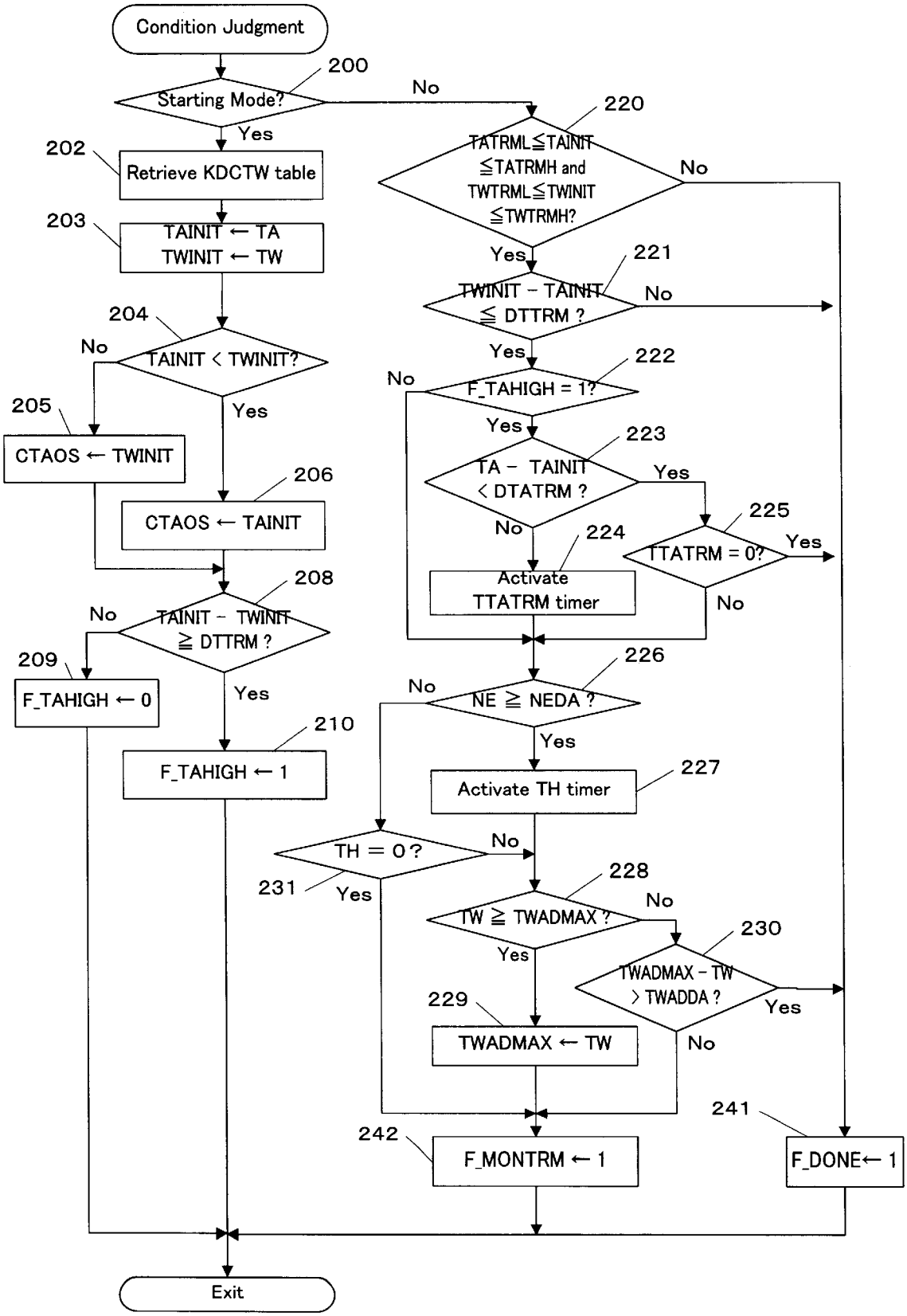
FIG. 6 is a flowchart showing a routine for judging whether conditions for carrying out a failure determination process are met, according to one embodiment of the invention.

FIG. 6 is a flowchart showing a routine for determining whether the conditions for executing the failure determination process are met. The routine is performed repeatedly at a predetermined interval (for example, every 200 milliseconds) independently of the main routine shown in FIG. 5.

Figure 13:
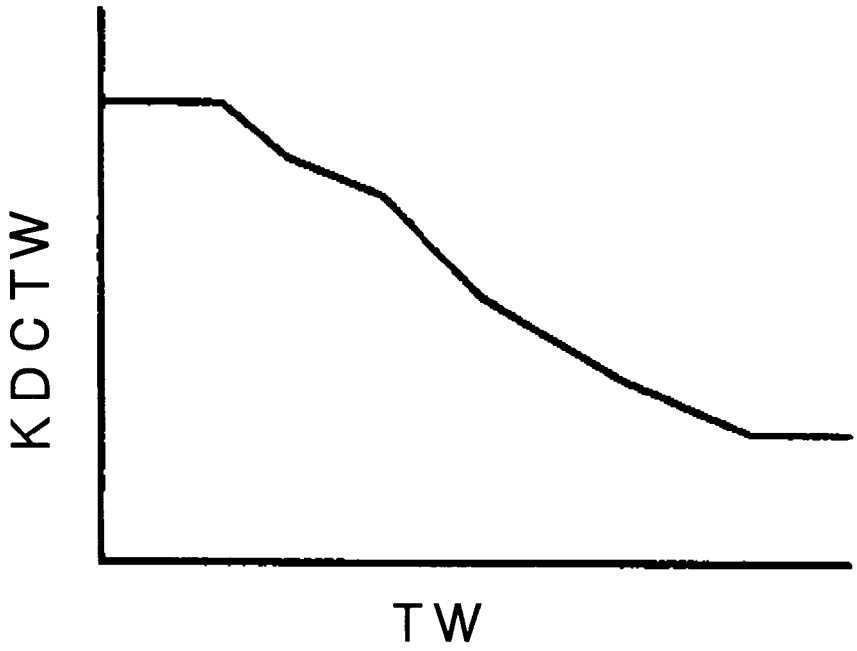
FIG. 13 shows an example of a water temperature correction value (KDCTW) table according to one embodiment of the invention.

In step 200, it is determined whether the engine is in a starting mode. The determination is performed in the same way as in step 110 of FIG. 5. When it is determined in step 200 that the engine is in the starting mode, the process proceeds to step 202. In step 202, a KDCTW table is retrieved based on the engine water temperature TW (which is detected by the driving conditions detector 81 shown in FIG. 3) to determine the water temperature correction value KDCTW. As shown in FIG. 13, the water temperature correction value KDCTW is predefined in the KDCTW table in such a way that it decreases in accordance with the increase of the engine water temperature TW.

The process proceeds to step 203, in which the outside air temperature TA detected by the driving conditions detector part 81 shown in FIG. 3 is set to an initial outside air temperature TAINIT. The engine water temperature TW detected by the driving conditions detector part 81 shown in FIG. 3 is set to the initial water temperature TWINIT.

In step 204, if the initial outside air temperature TAINIT is less than the initial water temperature TWINIT, then the initial outside air temperature TAINIT is set in the estimated outside air temperature CTAOS in step 205. If the initial outside air temperature TAINIT is not less than the initial water temperature TWINIT, the initial water temperature TWINIT is set in the estimated outside air temperature CTAOS in step 206. In other words, of the initial water temperature TWINIT and the initial outside air temperature TAINIT, the one having a smaller value is set in the estimated outside air temperature CTAOS.

The process proceeds to step 208, in which the initial water temperature TWINIT is subtracted from the initial outside air temperature TAINIT. If the subtracted value is equal to or greater than a predetermined value DTTRM (for example, 6° C.), it indicates that the outside air temperature is much higher than the engine water temperature. This implies a situation in which the outside air temperature has increased for some reason although the engine is sufficiently soaked. In this case, the process proceeds to step 210, in which a high outside air temperature flag F_TAHIGH is set to 1. On the other hand, when the subtracted value is less than the predetermined value DTTRM in step 208, the high outside air temperature flag F_TAHIGH is set to zero in step 209.

Returning to step 200, when it is not determined that the engine is in the starting mode, the process proceeds to step 220. Steps 220 through 221 indicate a process for determining whether the engine has been sufficiently soaked when it is started. In step 220, it is determined whether the initial outside air temperature TAINIT and the initial water temperature TWINIT are within predetermined ranges, respectively. More specifically, it is determined whether the initial outside air temperature TAINIT is between an upper limit value TATRMH (for example, 50° C.) and a lower limit value TATRML (for example, −7° C.). Also, it is determined whether the initial engine water temperature TWINIT is between an upper limit value TWTRMH (for example, 50° C.) and a lower limit value TWTRML (for example, −7° C.). It should be noted that the predetermined ranges for the initial outside air temperature TAINIT and the initial water temperature TWINIT do not need to have the same range.

When the initial outside air temperature TAINIT and the initial water temperature TWINIT are within their respective predetermined ranges, the process proceeds to step 221. In step 221, it is determined whether a difference between the initial outside air temperature TAINIT and the initial water temperature TWINIT is equal to or less than a predetermined value DTTRM (for example, 6° C.). When the difference between the outside air temperature TAINIT and the water temperature TWINIT is equal to or less than the predetermined value DTTRM, it indicates that the engine has been sufficiently soaked when it is started. In this case, the process proceeds to step 222.

If the initial outside air temperature TAINIT and the initial water temperature TWINIT are not within their respective predetermined ranges in step 220, or if the difference between the initial outside air temperature TAINIT and the initial water temperature TWINIT is greater than the predetermined value DTTRM in step 221, it indicates that the engine is not soaked. In this case, the process proceeds to step 241. The completion flag F_DONE is set to zero, prohibiting the failure determination process.

Steps 222 through 225 indicate a process for examining a variation in the outside air temperature. In step 222, the high outside air temperature flag F_TAHIGH set in step 209 or step 210 is examined. If the value of the high outside air temperature flag F_TAHIGH is zero, it indicates that the difference between the outside air temperature and the engine water temperature at the time of starting the engine is relatively small and that the engine has been soaked. In this case, the process proceeds to step 226. If the high outside air temperature flag F_TAHIGH is 1, a TTATRM timer is set in order to examine a variation in the outside air temperature for a predetermined period (for example 2 seconds) in step 224.

In a cycle after the timer TTATRM is set, if a difference between the detected outside air temperature TA and the initial outside air temperature TAINIT is equal to or greater than a predetermined value DTATRM (for example −4° C.), the TTATRM timer is reset. On the other hand, when the difference between the detected outside air temperature TA and the initial outside air temperature TAINIT is less than the predetermined value DTATRM, it indicates that the outside air temperature has decreased by more than a predetermined value since the engine was started. In this case, the process proceeds to step 225, in which it is determined whether the TTATRM timer set in step 224 has expired. Expiration of the TTATRM timer means that the outside air temperature has decreased continuously and significantly over the predetermined time period. Because it is not desirable to precisely estimate the engine water temperature in a situation where a variation in the outside air temperature is significant, the process proceeds to step 241. In step 241, the completion flag F_DONE is set to 1. If the timer TTATRM has not expired in step 225, the process proceeds to step 226. ***

Steps 226 through 231 indicate a process for determining whether the execution of the failure determination is permitted when it is detected that the engine operates at a high rotational speed. In step 226, it is determined whether the engine rotational speed NE (which is detected by the driving conditions detector 81 shown in FIG. 3) is equal to or greater than a predetermined rotational speed NEDA (for example, 5500 rpm). If the engine rotational speed NE is equal to or greater than the predetermined rotational speed NEDA, a TH timer (which is set to 10 seconds, for example) is activated in step 227.

In step 228, the engine water temperature detected in the current cycle and the maximum engine water temperature TWADMAX are compared. When this routine is initially entered, the maximum engine water temperature is set to zero as an initial value, (see step 141 of FIG. 5). Accordingly, the decision in step 228 is "Yes". In step 229, the engine water temperature TW detected in the current cycle is set to the maximum engine water temperature TWADMAX. Then, in step 242, the permission flag F_MONTRM is set to 1 to permit the execution of the failure determination.

When the routine is next entered, if the detected engine rotational speed NE is equal to or greater than the predetermined rotational speed NEDA in step 226, the process proceeds to step 227, in which the TH timer is reactivated.

In step 228, when the engine water temperature TW detected in the current cycle is equal to or greater than the maximum engine water temperature TWADMAX, the maximum engine water temperature TWADMAX is updated with the detected engine water temperature TW (step 229). This indicates that the engine water temperature has increased over the period from the previous cycle to the current cycle. In other words, it implies that a valve opening of the thermostat has not been caused by a high rotational speed. Therefore, the process proceeds to step 242, in which the permission flag F_MONTRM is set to 1 to permit the execution of the failure determination.

In step 228, if the engine water temperature TW detected in the current cycle is less than the maximum engine water temperature TWADMAX, a value gained by subtracting the engine water temperature TW from the maximum engine water temperature TWADMAX is examined in step 230. If the subtracted value is greater than a predetermined amount TWADDA (for example, 2° C.), it indicates that a decrease amount in the engine water temperature is significant, as described above with reference to FIG. 4. The process proceeds to step 241 in which the completion flag F_DONE is set to 1, prohibiting the execution of the failure determination process in this cycle.

When the value gained by subtracting the engine water temperature TW from the maximum engine water temperature TWADMAX is equal to or less than the predetermined amount TWADDA in step 230, it indicates that a decrease amount in the engine water temperature is small, or that the engine water temperature has increased. In other words, it implies that there has not occurred a valve opening of the thermostat. The process proceeds to step 242 in which the permission flag F_MONTRM is set to 1, permitting the execution of the failure determination.

If the engine rotational speed NE is less than the predetermined rotational speed NEDA in step 226, the process proceeds to step 231, in which it is determined whether the value of the TH timer is zero or not. If it is zero, it indicates that the TH timer activated in step 227 has expired (or the timer has not been activated). In this case, the process proceeds to step 242 in which the permission flag F_MONTRM is set to 1, permitting the execution of the failure determination process.

If the value of the timer TH is not zero in step 231, it indicates that the timer has not expired yet. Then, the process proceeds to step 228. It is determined whether the execution of the failure determination is permitted in accordance with the comparison result between the maximum engine water temperature TWADMAX and the detected engine water temperature TW, as described above.

Figure 7:
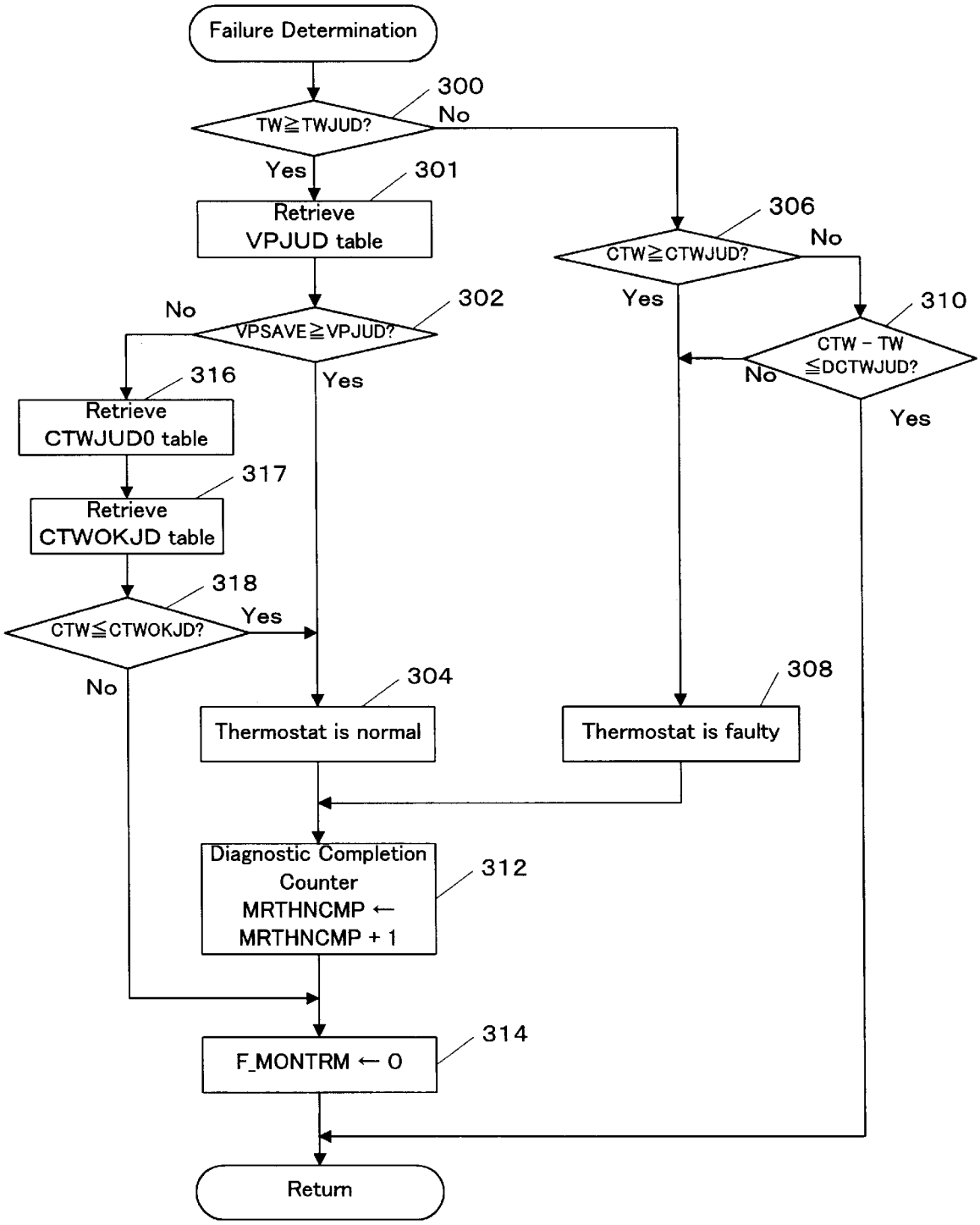
FIG. 7 is a flowchart showing a routine for determining a failure of a thermostat, according to one embodiment of the invention.
Figure 14:
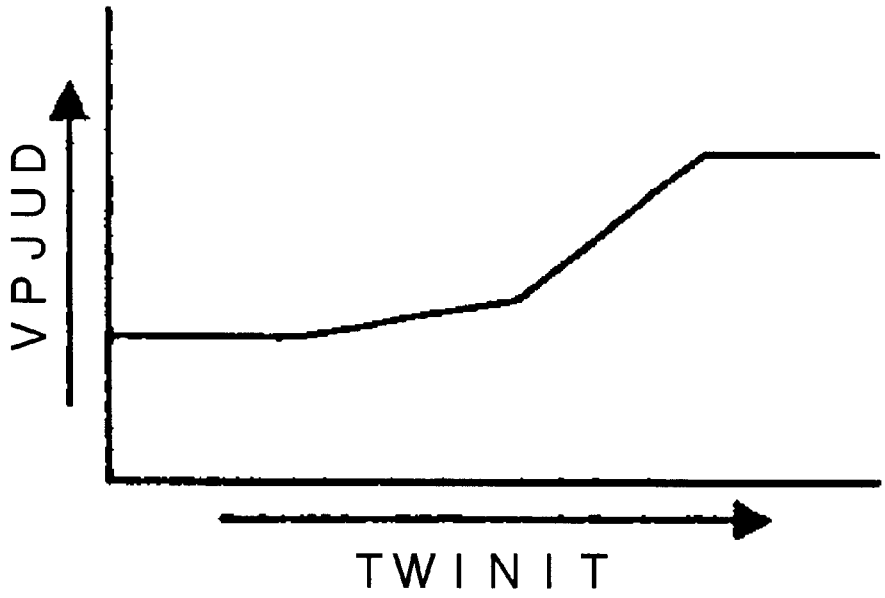
FIG. 14 shows an example of a reference vehicle speed (VPJUD) table according to one embodiment of the invention.

FIG. 7 is a flowchart showing a failure determination routine which is performed in step 140 of FIG. 5. In step 300, it is determined whether the detected engine water temperature TW is equal to or greater than a predetermined normal determination value TWJUD (for example, 70° C.). If the engine water temperature TW is equal to or greater than the normal determination value TWJUD, a VPJUD table is retrieved based on the initial engine water temperature TWINIT to determine a reference vehicle speed VPJUD in step 301. An example of the VPJUD table is shown in FIG. 14. In step 302, it is determined whether an average vehicle speed VPSAVE that has been calculated in step 138 of FIG. 5 is equal to or greater than the reference vehicle speed VPJUD. If the average vehicle speed VPSAVE is equal to or greater than the reference vehicle speed VPJUD, it is determined that the thermostat is normal in step 304.

When the average vehicle speed VPSAVE is less than the reference vehicle speed VPJUD in step 302, the process proceeds to step 316. When the vehicle speed is low, the wind against the radiator is weak. Therefore, the water temperature may quickly increase even if a failure has taken place in the thermostat. A process carried out in steps 316 through 318 allows a wrong determination under such a situation to be avoided.

Figure 15:
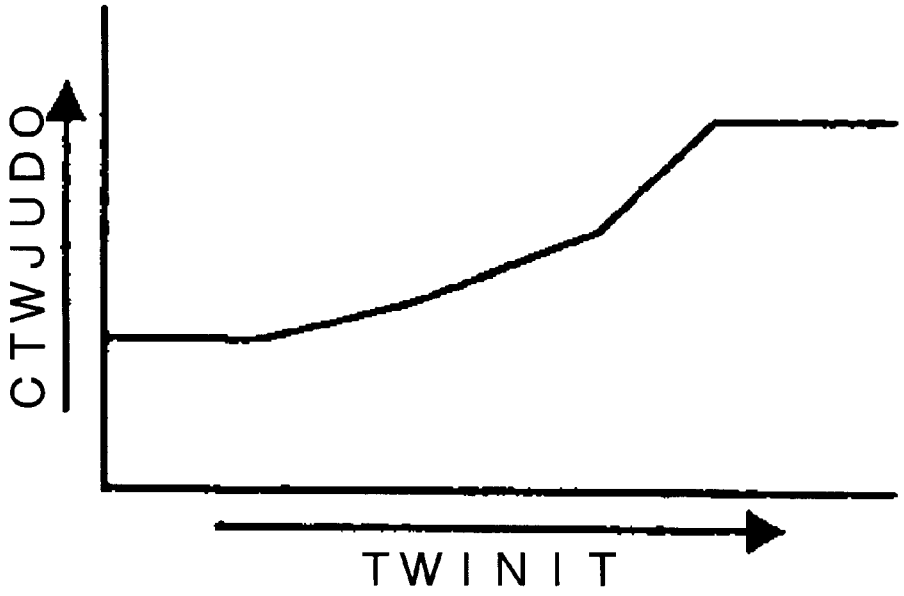
FIG. 15 shows an example of an estimated water temperature (CTWJUD0) table for creating a CTWOKJD table according to one embodiment of the invention.
Figure 16:
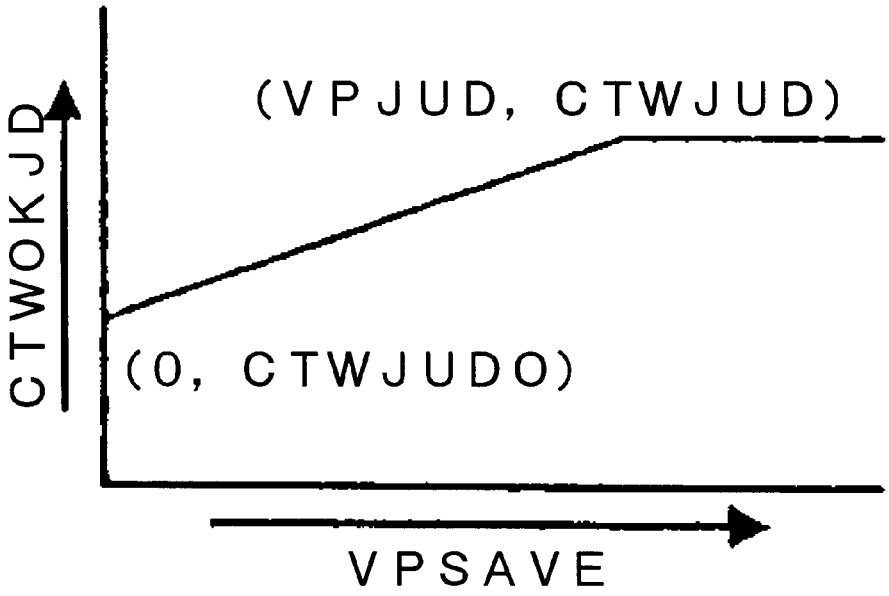
FIG. 16 shows an example of an estimated water temperature (CTWOKJD) table for a normal determination according to one embodiment of the invention.

In step 316, a CTWJUD0 table is retrieved based on the initial engine water temperature TWINIT to determine an estimated water temperature CTWJUD0, which is to be used to create a CTWOKJD table (FIG. 16). An example of the CTWJUD0 table is shown in FIG. 15. The process proceeds to step 317, in which a CTWOKJD table is retrieved based on the average vehicle speed VPSAVE to determine an estimated water temperature CTWOKJD that is used for the normal determination. An example of the CTWOKJD table is shown in FIG. 16. A graph shown in FIG. 16 is created by connecting a point in which the average vehicle speed is zero and the estimated water temperature has a value of the estimated water temperature CTWJUD0 determined in step 316, with a point in which the average vehicle speed has a value of the reference vehicle speed VPJUD and the estimated water temperature has a value of a predetermined failure determination value CTWJUD.

The process proceeds to step 318. If the estimated water temperature CTW determined in step 132 of FIG. 5 is equal to or less than the estimated water temperature CTWOKJD, it is determined that the thermostat is normal. In other words, if the engine water temperature TW has reached the normal determination value TWJUD before the estimated water temperature CTW reaches the estimated water temperature CTWOKJD, it indicates that the increase in the engine water temperature has not been caused by low speed of the vehicle. Accordingly, it is determined that the thermostat is normal. If the estimated water temperature CTW is greater than the estimated water temperature CTWOKJD in step 318, the failure determination is not performed, and the process proceeds to step 314. This is because the cause of the increase in the engine water temperature may be a low speed of the vehicle.

Returning to step 300, if the engine water temperature TW is less than the normal determination value TWJUD, the process proceeds to step 306. In step 306, it is determined whether the estimated water temperature CTW has reached the failure determination value CTWJUD (for example, 75° C.). If the estimated water temperature CTW is equal to or greater than the failure determination value CTWJUD, it is determined that a failure occurred in the thermostat in step 308. In other words, it is determined that there has occurred an opening failure (or other failures, such as increased amount of leakage or a decrease in the temperature for opening the valve) on the thermostat, because the detected engine water temperature has not yet reached the normal determination value TWJUD when the estimated water temperature has reached the failure determination value CTWJUD.

If the estimated water temperature CTW is less than the failure determination value CTWJUD (for example, 75° C.) in step 306, the process proceeds to step 310. If a value gained by subtracting the engine water temperature TW from the estimated water temperature CTW is greater than a second failure determination value DCTWJUD (for example, 15° C.) in step 310, it is determined that a failure has occurred in the thermostat in step 308. In other words, when the estimated water temperature is much higher than the detected engine water temperature, the determination that a failure has occurred in the thermostat is made before the estimated water temperature reaches the failure determination value.

If the value gained by subtracting the engine water temperature TW from the estimated water temperature CTW is equal to or less than the second failure determination value DCTWJUD in step 310, the failure determination is not performed and the process exits from the routine because it is not possible to determine whether a failure has occurred.

If the thermostat failure determination has been performed in step 304 or step 308, the process proceeds to step 312, in which a diagnostic completion counter MRTHNCMP is incremented. Then, in step 314, the permission flag F_MONTRM is reset to zero.

Figure 8:
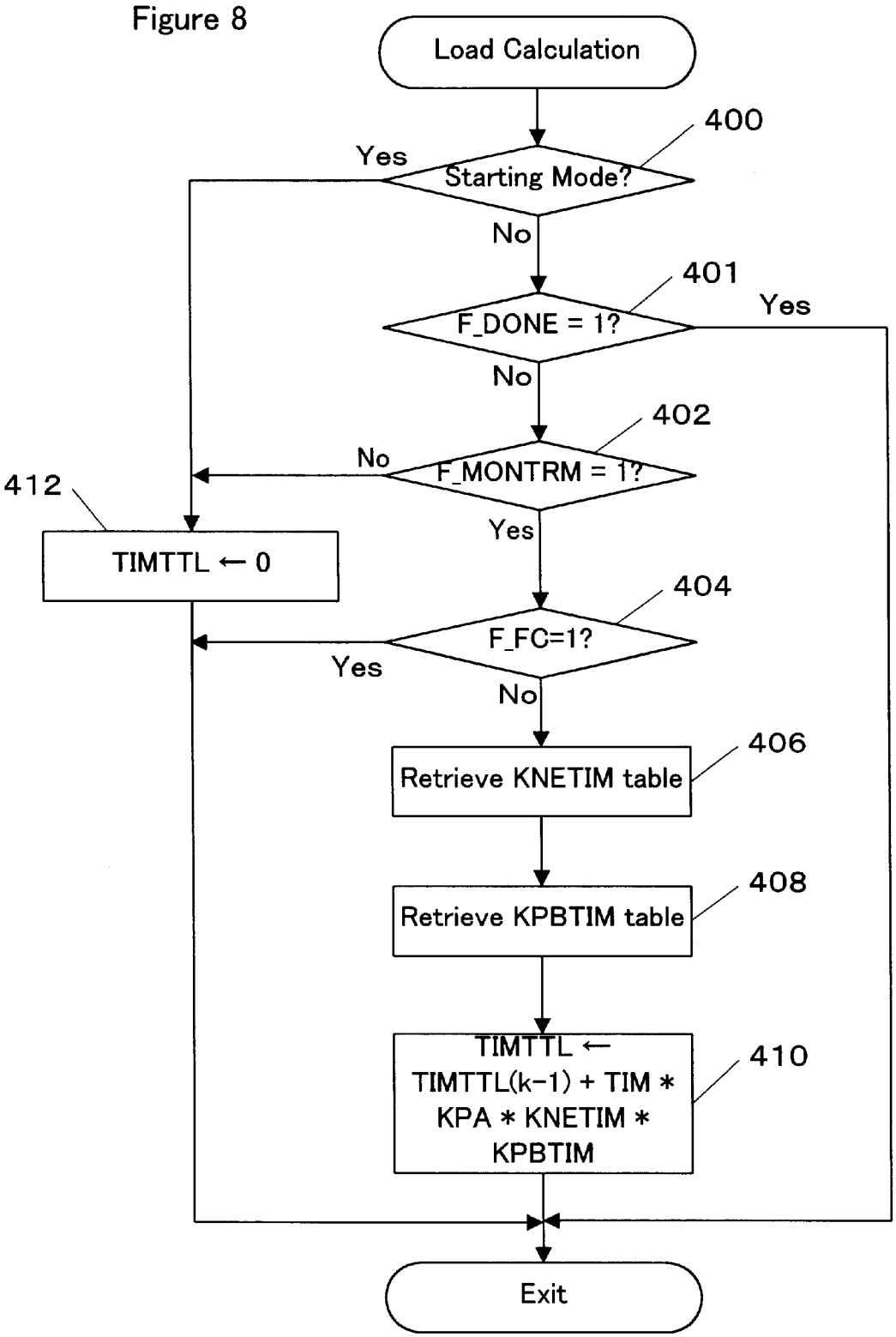
FIG. 8 is a flowchart showing a routine for calculating an accumulated engine load value, according to one embodiment of the invention.

FIG. 8 is a flowchart of a routine for calculating the accumulated engine load value TIMTTL to be used in step 128 of FIG. 5. The routine is executed every time a predetermined crank angle (for example, a crank angle indicating the TDC position) is detected. The routine may be performed at a predetermined interval.

In step 400, it is determined whether the engine is in a starting mode. This determination is made in the same way as in step 110 of FIG. 5. If it is determined that the engine is not in the starting mode, the process proceeds to step 401, in which the completion flag F_DONE is examined. If the completion flag F_DONE is 1, the process exits from the routine because the execution of the failure determination has completed in the current driving cycle.

If the completion flag F_DONE is zero, the permission flag F_MONTRM is examined in step 402. If the permission flag F_MONTRM is 1, the process proceeds to step 404 because the flag indicates that the execution of the failure determination has been permitted.

Figure 17:
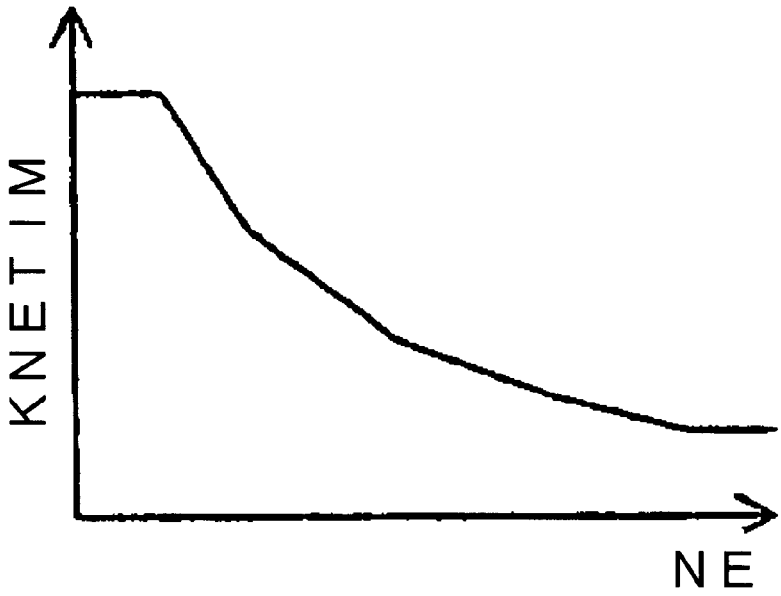
FIG. 17 shows an example of an engine rotational speed correction value (KNETIM) table according to one embodiment of the invention.

In step 404, a fuel-cut flag F_FC is examined. The fuel-cut flag is a flag that is to be set to 1 when a fuel-cut operation is performed. When the value of the flag F_FC is zero, the process proceeds to step 406. In step 406, a KNETIM table is retrieved based on the engine rotational speed NE to determine a rotational speed correction value KNETIM. FIG. 17 shows an example of the KNETIM table. As seen in FIG. 17, the rotational speed correction value KNETIM decreases in accordance with the increase of the rotational speed NE.

Figure 18:
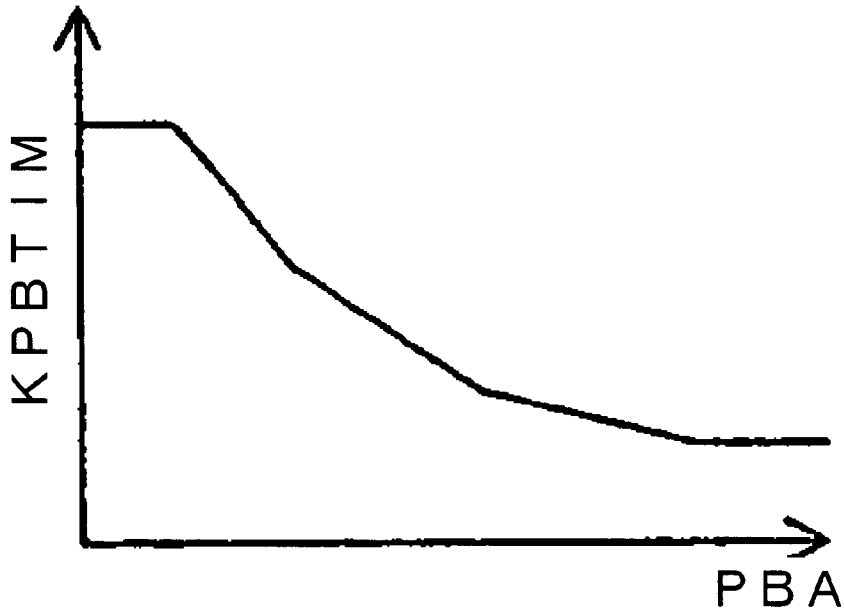
FIG. 18 shows an example of an engine load correction value (KPBTIM) table according to one embodiment of the invention.

In step 408, a KPBTIM table is retrieved based on the detected intake manifold pressure PBA (which is detected by the driving conditions detector 81 shown in FIG. 3) to determine a load correction value KPBTIM. FIG. 18 shows an example of the KPBTIM table. The load correction value KPBTIM decreases in accordance with the increase of the intake manifold pressure PBA as shown in FIG. 18.

The process proceeds to step 410, in which the accumulated engine load value TIMML is determined. More specifically, a product of the basic injection time of the fuel TIM, a multiplication correction coefficient KPA, the rotational speed correction value KNETIM determined in step 406, and the load correction value KPBTIM determined in step 408 is determined. The determined product is added to the accumulated engine load value TIMTTL(k−1) determined in the previous cycle, to determine the accumulated engine load value TIMTTL in the current cycle. The basic injection time TIM is a value determined from a map of the engine rotational speed NE and the intake manifold pressure PBA. The correction coefficient KPA is a coefficient for correcting the basic injection time TIM. The correction coefficient KPA is determined according to driving conditions.

When the engine is not in the starting mode in step 400, or when the permission flag F_MONTRM is zero in step 402, the process proceeds to step 412. In step 412, the accumulated engine load value TIMTTL is set to zero, and the process exits from the routine. Also, when the fuel-cut flag F_FC is 1 in step 404, that is to say, when the fuel injection is not being performed, the process exits from the routine.

What is claimed is:

1. A controller for determining a failure of a thermostat that opens and closes a passage through which cooling water circulates between a radiator and an engine, the controller configured to prohibit the failure determination if a water temperature of the engine decreases by more than a predetermined amount during a predetermined period from the time when a rotational speed of the engine exceeds a predetermined rotational speed.

2. The controller according to claim 1, further configured to update a maximum value of the water temperature during the predetermined period, wherein the decrease in the water temperature is measured with respect to the maximum value.

3. The controller according to claim 1, wherein the decrease of the water temperature is measured with respect to a water temperature that is detected in a previous cycle.

4. The controller according to claim 1, further configured to carry out the thermostat failure determination when all of the following conditions are met:

a) an outside air temperature at the time of starting the engine and the water temperature at the time of starting the engine are within predetermined ranges, respectively;

b) a difference between the outside air temperature at the time of starting the engine and the water temperature of the engine at the time of starting the engine is equal to or less than a predetermined value; and c) the outside air temperature does not decrease by more than a predetermined amount from the time of starting the engine.

5. The controller according to claim 1, further configured:

to determine an estimated water temperature of the engine;

to compare a rise in the water temperature of the engine detected by a sensor with a rise in the estimated water temperature; and to determine whether a failure has occurred in the thermostat based on the comparison result.

6. The controller according to claim 5, wherein the estimated water temperature is determine based on the water temperature of the engine that is detected at the time of starting the engine and a thermal load that contributes to an increase in the water temperature of the engine.

7. The controller according to claim 6, wherein the thermal load is determined based on at least an accumulated engine load.

8. The controller according to claim 6, wherein the thermal load is determined based on an accumulated engine load and an accumulated cooling loss.

9. A method for determining a failure of a thermostat that opens and closes a passage through which cooling water circulates between a radiator and an engine, the method comprising:

determining whether a rotational speed of the engine exceeds a predetermined rotational speed;

if the rotational speed exceeds the predetermined rotational speed, determining whether a water temperature of the engine decreases by more than a predetermined amount during a predetermined period from the time when the rotational speed exceeds the predetermined rotational speed; and if the water temperature decreases by more than the predetermined amount, prohibiting the failure determination.

10. The method according to claim 9, further comprising updating a maximum value of the water temperature during the predetermined period, wherein the decrease in the water temperature is measured with respect to the maximum value.

11. The method according to claim 9, wherein the decrease of the water temperature is measured with respect to a water temperature that is detected in a previous cycle.

12. The method according to claim 9, wherein the failure determination is performed when all of the following conditions are met:

a) an outside air temperature at the time of starting the engine and the water temperature of the engine at the time of starting the engine are within predetermined ranges, respectively;

b) a difference between the outside air temperature at the time of starting the engine and the water temperature of the engine at the time of starting the engine is equal to or less than a predetermined value; and c) the outside air temperature does not decrease by more than a predetermined amount from the time of starting the engine.

13. The method according to claim 9, further comprising:

determining an estimated water temperature of the engine;

comparing a rise in the water temperature of the engine detected by a sensor with a rise in the estimated water temperature; and determining whether a failure has occurred in the thermostat based on the comparison result.

14. The method according to claim 13, wherein the estimated water temperature is determined based on the water temperature of the engine that is detected at the time of starting the engine and a thermal load that contributes to an increase in the water temperature of the engine.

15. A computer program executable on a computer system for determining a failure of a thermostat, the thermostat opening and closing a passage through which cooling water circulates between a radiator and an engine, the program performing:

determining whether a rotational speed of the engine exceeds a predetermined rotational speed;

if the rotational speed exceeds the predetermined rotational speed, determining whether a water temperature of the engine decreases by more than a predetermined amount during a predetermined period from the time when the rotational speed exceeds the predetermined rotational speed; and if the water temperature decreases by more than the predetermined amount, prohibiting the failure determination.

16. The computer program according to claim 15, further performing updating a maximum value of the water temperature during the predetermined period, wherein the decrease in the water temperature is measured with respect to the maximum value.

17. The computer program according to claim 15, wherein the decrease of the water temperature is measured with respect to a water temperature that is detected in a previous cycle.

18. The computer program according to claim 15, wherein the failure determination is performed when all of the following conditions are met:

a) an outside air temperature at the time of starting the engine and an engine water temperature of the engine at the time of starting the engine are within predetermined ranges, respectively;

b) a difference between the outside air temperature at the time of starting the engine and the engine water temperature of the engine at the time of starting the engine is equal to or less than a predetermined value; and c) the outside air temperature does not decrease by more than a predetermined amount from the time starting the engine.

19. The computer program according to claim 15, further performing:

determining an estimated water temperature of the engine;

comparing a rise in the water temperature of the engine detected by a sensor with a rise in the estimated water temperature; and determining whether a failure has occurred in the thermostat based on the comparison result.

20. The computer program according to claim 19, wherein the estimated water temperature is determined based on the water temperature of the engine that is detected at the time of starting the engine and a thermal load that contributes to an increase in the water temperature of the engine.

* * * * *